US008079231B2

(12) United States Patent
Brachert et al.

(10) Patent No.: US 8,079,231 B2
(45) Date of Patent: Dec. 20, 2011

(54) HOUSING FOR A REFRIGERATOR

(75) Inventors: Rainer Brachert, Gundelfingen (DE); Christian Mayershofer, Grundremmingen (DE); Rudolf Schmidt, Giengen (DE); Anton Stempfle, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/801,955

(22) Filed: Mar. 15, 2004

(65) Prior Publication Data

US 2004/0172964 A1 Sep. 9, 2004

Related U.S. Application Data

(63) Continuation of application No. PCT/EP02/10145, filed on Sep. 10, 2002.

(30) Foreign Application Priority Data

Sep. 13, 2001 (DE) ..... 101 45 140

(51) Int. Cl.
*F25D 17/04* (2006.01)

(52) U.S. Cl. ..... 62/407

(58) Field of Classification Search ..... 62/407, 62/416, 417, 447, 440; 312/311, 351, 408
See application file for complete search history.

(56) References Cited

U.S. PATENT DOCUMENTS

| | | | | |
|---|---|---|---|---|
| 2,884,296 | A * | 4/1959 | Meilinger et. al. | 312/263 |
| 3,160,448 | A * | 12/1964 | Abernathy et. al. | 384/23 |
| 3,601,463 | A | 8/1971 | Watt | |
| 3,805,545 | A | 4/1974 | Buchser et al. | |
| 3,872,688 | A | 3/1975 | Tillman | |
| 4,191,434 | A | 3/1980 | Powell et al. | |
| 4,955,676 | A | 9/1990 | Weaver et al. | |

FOREIGN PATENT DOCUMENTS

| | | |
|---|---|---|
| CH | 442 378 | 1/1968 |
| DE | 1 601 093 | 5/1970 |
| DE | 1 925 147 | 11/1970 |
| JP | 10062060 A | 3/1998 |
| JP | 2000304431 A | 11/2000 |

* cited by examiner

*Primary Examiner* — Melvin Jones
(74) *Attorney, Agent, or Firm* — James E. Howard; Andre Pallapies

(57) ABSTRACT

A housing for a refrigeration device is composed of an outer housing box that encloses an interior space, and at least one intermediate mounted shelf disposed in the interior space. The intermediate mounted shelf contains a pre-shaped core made of solid foam material, which is directly fastened on the inner wall of the housing box.

15 Claims, 3 Drawing Sheets

HOUSING FOR A REFRIGERATOR

CROSS-REFERENCE TO RELATED APPLICAITON

This application is a continuation, under 35 U.S.C. §120, of copending international application No. PCT/EP02/10145, filed Sep. 10, 2002, which designated the United States; this application also claims the priority, under 35 U.S.C. §119, of German patent application No. 101 45 140.7, filed Sep. 13, 2001; the prior applications are herewith incorporated by reference in their entirety.

BACKGROUND OF THE INVENTION

Field of the Invention

The present invention relates to a housing for a refrigerator. The refrigerator has an outer housing box which surrounds an interior space, and at least one shelf which is mounted in the interior space in order to divide it into subspaces. Typical refrigerators of this type are combination appliances, in which one subspace acts as a freezer compartment and a second acts as a normal cooling compartment. Refrigerators having a plurality of shelves and whose interior space is divided into a freezer compartment, a normal cooling compartment and a cellar-type compartment are also known.

Since different temperatures have to be maintained in the different subspaces, the shelves have to tightly adjoin the inner wall of the housing box and, in a similar manner to the outer housing box, which surrounds all of the subspaces, have to be thermally insulated.

Shelves of this type are conventionally constructed as hollow bodies that adjoin by their lateral flanks tightly to the inner walls of the housing box and are subsequently filled with foam in order to achieve the necessary insulating power. This technique is similar to the one conventionally also used to produce the outer housing box: the latter is assembled from outer and inner walls which delimit between them a cavity that is filled with foam to provide heat insulation.

This technique is costly since the production of a hollow part, for example by blow-molding or injection-molding techniques, requires expensive hollow molds, and the tight fastening of these parts in the housing box with the aim of subsequently filling them with foam is complicated and labor intensive.

In addition, the intimate bond which arises during the foam-filling process between the foam material and the hollow body that it fills would make it difficult to recover the used materials in a manner in which they are intact in terms of type if the refrigerator is dismantled after the end of service life.

SUMMARY OF THE INVENTION

It is accordingly an object of the invention to provide a housing for a refrigerator that overcomes the above-mentioned disadvantages of the prior art devices of this general type, in which the housing has an interior space divided by a shelf, and the costs for producing the internal shelf are reduced and its fitting is simplified. It is a further object to specify a recycling-friendly housing.

With the foregoing and other objects in view there is provided, in accordance with the invention, a housing for a refrigerator. The housing contains an outer housing box having an inner wall and defining and surrounding an interior space. At least one shelf is fitted in the interior space and defines subspaces. The shelf has a preformed core formed of a foam material fastened to the inner wall of the outer housing box. The preformed core has lateral flanks and means disposed on the lateral flanks for obtaining an effective sealing between the subspaces produced by the shelf.

Instead of producing a hollow body and filling the latter later with insulating foam, the invention envisages first producing an insulating body or core of a foam material, the strength of which is sufficient in order to fasten it directly to the inner wall of the housing. This makes it unnecessary to fabricate a hollow body with precise dimensions. An impervious covering of the core, which is desirable to protect the foam material from contamination and from the penetration of moisture, can be constructed from one or more panels that are simple to produce.

The shelf of foam material can be fitted in a simple manner by pushing the core onto at least one channel or a projection that is formed on the inner wall of the housing box. It is expedient in each case to form, on a lateral flank of the core, a projection that is complementary to a channel of the inner wall or a channel that is complementary to a projection of the inner wall.

In order to obtain an effective sealing between the subspaces on both sides of the shelf, knobs may be provided on the lateral flanks of the core, the knobs being deformed when the core is pushed into the interior space and thereby ensuring that the core is tightly connected to the inner wall.

As an alternative, a sealing tape may be disposed on the lateral flanks of the core.

The panels (already mentioned) of the impervious covering are expediently held on the core by a plug-in or clamping connection. A connection of this type can easily be released during the disassembly of the refrigerator and promotes a recovery of the used materials in a manner in which they are intact in terms of type. In addition, it permits a simple replacement of individual panels in the event of damage, in contrast with the conventional technique in which, in the event of the hollow body being damaged, it has to be entirely replaced together with its foam filling.

At least one groove for accommodating heating devices is preferably formed on a front side of the core and, if each of the subspaces is assigned its own door, the groove prevents condensation of air moisture on the front side of the core.

If a fan is provided in the subspace situated below the shelf, in particular for circulating cold air in the subspace, then preferably at least one rib is formed on the lower side of the shelf, the rib surrounding a surface of the lower side, below which the fan is disposed. If moisture precipitates on the lower side of the shelf outside this surface, a rib of this type prevents drops of condensation water from migrating along the lower side to a position above the fan and dripping onto the latter.

Likewise in order to protect the fan from drops of condensate, that surface of the lower side that is surrounded by the rib may be shaped concavely, so that condensate forming on the surface drains in the direction of the rib and drips off on the latter.

The core is preferably produced from EPS (polystyrene foam).

Other features which are considered as characteristic for the invention are set forth in the appended claims.

Although the invention is illustrated and described herein as embodied in a housing for a refrigerator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
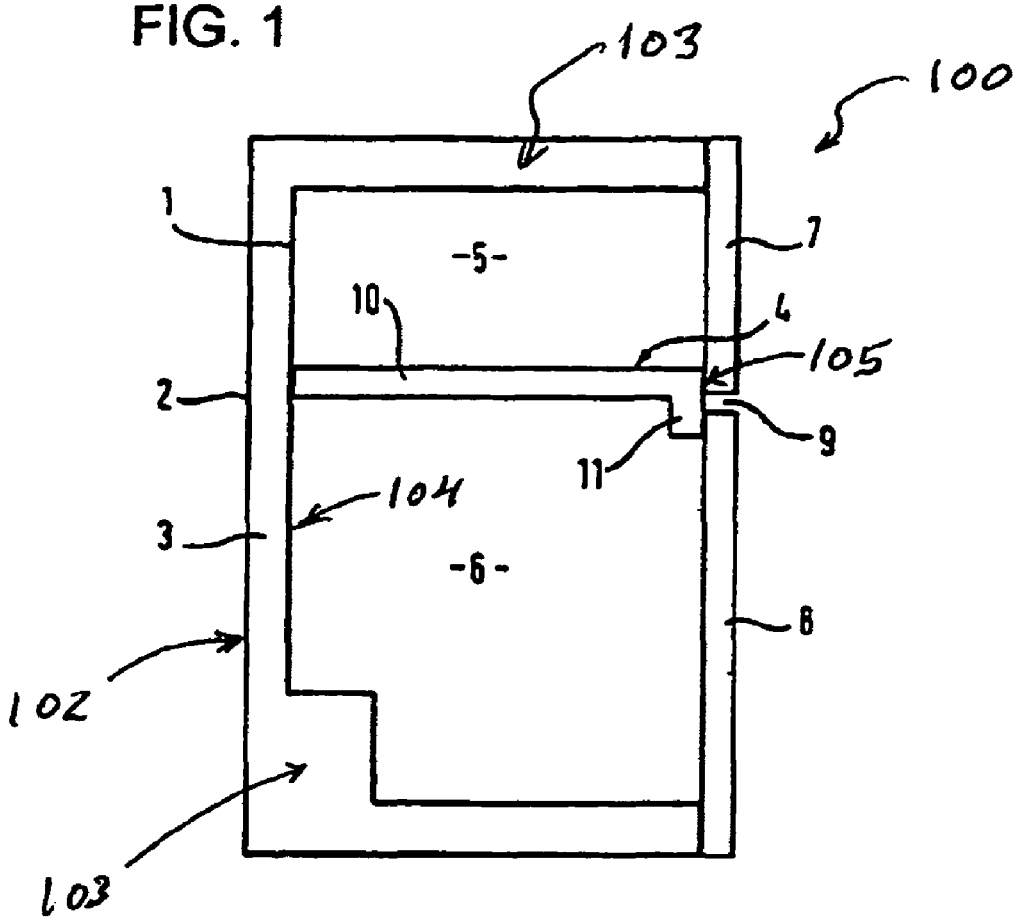
FIG. 1 is a diagrammatic, sectional view of a refrigerator having an interior space divided by a shelf according to the invention.

Referring now to the figures of the drawing in detail and first, particularly, to FIG. 1 thereof, there is shown a highly diagrammatized illustration of a section through a refrigerator housing 100, in which the present invention can be used. The housing contains an outer housing box 102, which is composed of an inner container 1 and outer walls 2 and in which an intermediate space 3 between the inner container 1 and outer walls 2 is filled with insulating foam 103. A shelf 4 divides an interior space of the housing box into an upper subspace 5, for example a freezer compartment, and a lower subspace 6, for example a normal cooling compartment. Each of the subspaces 5, 6 is assigned a respective door 7 and 8 which are adjacent to a gap 9 level with the shelf 4.

The shelf 4 has an essentially L-shaped cross section with a horizontal main section 10, which extends from the doors 7, 8 as far as a rear wall 104 of the inner container 1, and a section 11 that is angled downward on a front edge 105 of the main section 10. The shape of the shelf 4 ensures, first, that level with the gap 9 there is a sufficiently thick insulating layer to protect against heat penetrating into the gap from the outside; second, the thickness of the main section 10 can remain limited over most of the main section to a small value required for an effective heat insulation between the subspaces 5, 6 and for a sufficient mechanical strength of the shelf 4 in order not to impair the available storage volume in the inner container 1 beyond the necessary extent.

Figure 2:
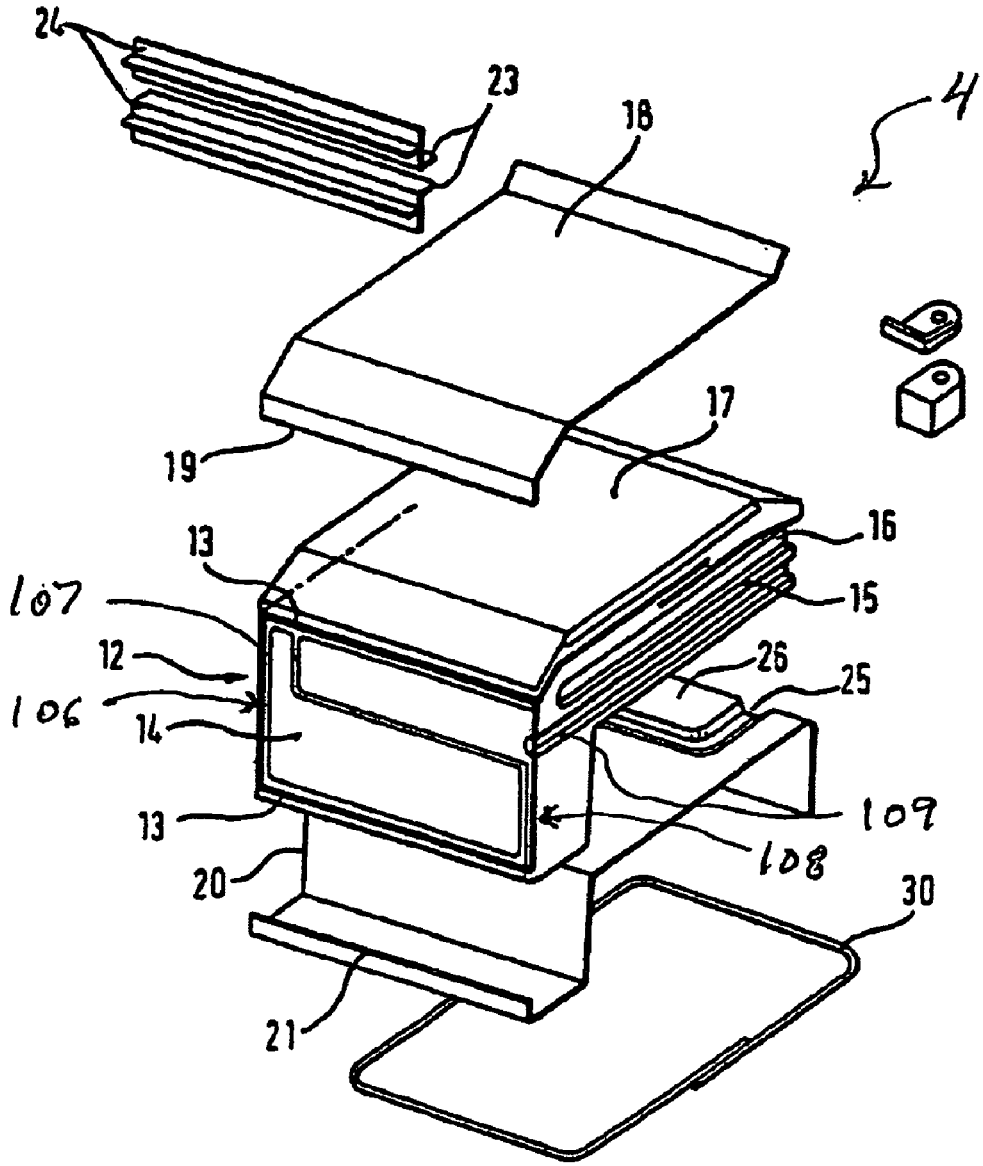
FIG. 2 is an exploded, perspective view of the shelf.

FIG. 2 shows, in a perspective, exploded illustration, the construction of the shelf 4. The self contains a single-part core 12 of expanded polystyrene (EPS) that substantially fills the shelf 4.

Two horizontal grooves 13 are formed on a front side 14 of the core 12, which side 14 faces the observer. They are provided in order to accommodate a non-illustrated hot gas pipe through which warm refrigerant is conducted after it has passed through the condenser of a refrigerating machine (not illustrated) and before it passes through a heat exchanger (not illustrated). This keeps the front side 14 sufficiently warm such that a formation of condensation water in the gap 9 is avoided. The horizontal grooves 13 are connected in a left edge region 106 of the front side 14 by a vertical groove 107 and merge on a right edge region 108 into grooves 109 extending along a right side flank 15, with the result that the hot gas pipe can be laid continuously through these grooves.

A sealing tape 30 of a closed-pore foam material, such as, for example, cellular polyethylene, is provided in order, following the fitting of the hot gas line, to be disposed in the grooves thereof or in non-illustrated grooves dedicated to the sealing tape 30 on the side flanks 15, front side 14 and rear side of the core 12 and thus to ensure a tight connection of the shelf 4 to the inner container 1. Although only one sealing tape 30 is shown in FIG. 2, such sealing tapes may also be placed in twos, in each case in the vicinity of the upper and lower sides of the core 12.

A respective guide groove 16 extends in the horizontal direction on both side flanks 15 of the core 12. The guide groove 16 is provided in order to accommodate a complementary rib 28 (shown in FIG. 4), that is formed on the inner container 1, so that the shelf 4 can be fitted by simple pushing the core 12 onto the ribs 28. Of course, a horizontal rib (not illustrated) could also be provided with the same effect on a side flank of the core, the rib engaging in a complementarily shaped groove (not illustrated) in a side wall of the inner container 1.

An upper side 17 of the core 12 is protected against damage and contamination by an upper covering panel 18, for example of solid polystyrene. The covering panel 18 engages by its downwardly bent, front edge 19 in the upper of the two grooves 13; an analogous groove engagement with a groove on one of the side flanks 15 of the core or on the rear side thereof (not illustrated) may also be provided in order to clamp the upper covering panel 18 to the core 12. As an alternative, the lower side of the upper covering panel could also be provided with spikes (not illustrated) —possibly equipped with barbs (not illustrated) —which can be driven into the core 12 in order to install the covering panel thereon.

In both cases, an adhesive bond is not required between the covering panel 18 and core 12, which makes it possible for them to be separated from each other during disassembly in a manner in which they are intact in terms of type.

A lower covering panel 20 which covers a lower side of the core 12 is equipped on its front edge 21 in an analogous manner to the covering panel 18 with a retaining lug for engagement in the lower of the grooves 13. It may also be clamped in the same manner as the upper covering panel 18 to the core 12 without an adhesive bond by engagement of a further retaining lug (not illustrated) in a lateral or rear groove of the core; a fastening with the aid of spikes (not illustrated) is also suitable.

Figure 3:
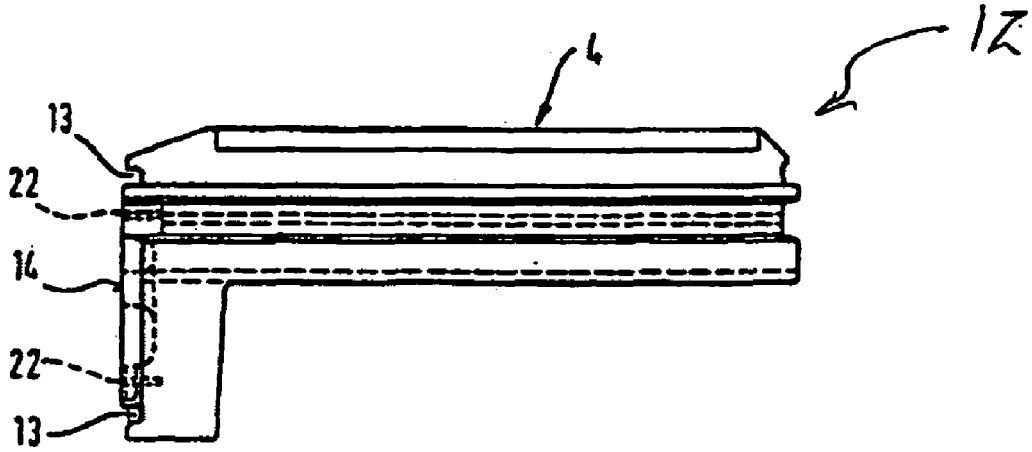
FIG. 3 is a side-elevational view of a core of the shelf.

As can be seen more clearly in the side view of the core 12 of FIG. 3, two narrow slots 22, which can be formed in a simple manner by cutting into the material of the core, are situated on the front side 14 of the core 12 parallel to the grooves 13. These slots 22 are provided in order to receive tongues 23 of upper and lower cross pieces 24 (shown in FIG. 2) which can be formed as extruded profiles of plastic or metal and, first, can serve to stiffen the shelf 4 and, second, serve as a support for a non-illustrated metallic screen which completely covers the front side 14 of the core 12.

Figure 4:
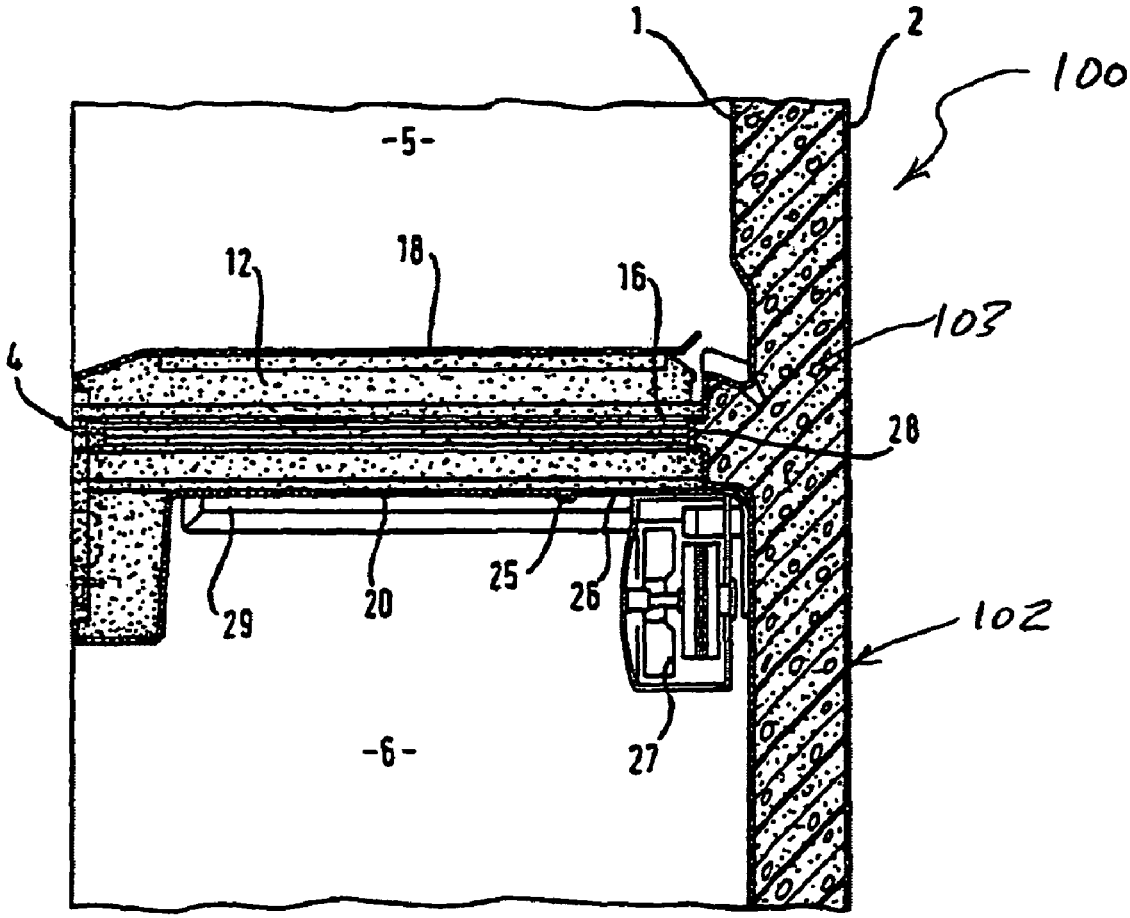
FIG. 4 is a partial section view through a refrigerator housing having the shelf.

FIG. 2 furthermore shows a downwardly directed rib 25 on the lower covering panel 20, the rib 25 extending in an approximately C-shaped manner around a surface 26 of the lower covering panel 20, which surface 26 is adjacent to the rear wall 104 of the inner container 1 in the fitted state of the shelf 4. As the section view of FIG. 4 shows, the surface 26 is provided in order to accommodate an electric fan 27 below it in the lower subspace 6. The rib 25 prevents drops of moisture that might be formed, for example, by condensation on the lower covering panel 20 outside the surface 26 surrounded by the rib 25, from reaching the fan 27. A corresponding protection of the fan 27 against condensate forming on the surface 26 can be achieved if the surface 26 is sloped toward the rib 25 (not illustrated).

As can be seen in FIG. 4, the guide groove 16 extends not only over the side flanks 15 of the core 12, but also over the rear side thereof, and a rib 28 which engages in a load-bearing manner in the guide groove 16 is also formed on the rear wall of the inner container 1. The shelf 4 thereby obtains a high load-bearing capacity without excessive wall thicknesses of the covering panels 18, 20 or of the core 12 being required for this.

In order to additionally support the shelf 4, it is possible, as shown, for an additional rib 29 also to be formed on the inner container 1 in the region of the lower subspace 6, the lower covering panel 20 resting on said rib.

We claim:

1. A housing for a refrigerator, comprising:

an outer housing box having an inner wall and defining and surrounding an interior space; and at least one shelf fitted in said interior space and defining subspaces, said shelf having a preformed core formed of a foam material fastened to said inner wall of said outer housing box, said preformed core having lateral flanks and means disposed on said lateral flanks for obtaining an effective sealing between said subspaces produced by said shelf.

2. The housing according to claim 1, wherein said shelf has a sealing tape disposed on said lateral flanks of said preformed core.

3. The housing according to claim 1, wherein said inner wall of said outer housing box has a channel formed therein, and said shelf is pushed onto said channel.

4. The housing according to claim 3, wherein said channel is provided for securing said shelf to said inner wall of said outer housing box on both of said lateral flanks of said shelf.

5. The housing according to claim 3, wherein said channel secures said shelf to said inner wall of said outer housing box on both of said lateral flanks of said preformed core.

6. The housing according to claim 1, wherein:

said preformed core has an upper side, a front side, and a lower side; and said shelf has at least one impervious covering panel disposed on at least one of said upper side, said front side, and said lower side of said preformed core.

7. The housing according to claim 6, wherein said impervious covering panel is held on said preformed core by a plug-in connection.

8. The housing according to claim 1, wherein said preformed core has a front side with a least one groove formed therein for accommodating heating devices.

9. The housing according to claim 1, further comprising a fan; and wherein said shelf has a lower side with a surface and at least one rib formed on said lower side, said rib surrounding said surface of said lower side, and below said surface said fan is disposed.

10. The housing according to claim 1, wherein said preformed core is formed from polystyrene foam.

11. The housing according to claim 6, wherein said impervious covering panel is held on said preformed core by a clamping connection.

12. The housing according to claim 1, wherein said inner wall of said outer housing box has a projection, and said shelf is pushed onto said projection.

13. The housing according to claim 12, wherein said projection is provided for securing said shelf to said inner wall of said outer housing box on both of said lateral flanks of said shelf.

14. The housing according to claim 12, wherein said projection secures said shelf on said inner wall of said outer housing box on both of said lateral flanks of said preformed core.

15. The housing according to claim 1, wherein said preformed core is formed of a solid foam material.

* * * * *